US005370048A

United States Patent [19]

Pietsch et al.

[11] Patent Number: 5,370,048

[45] Date of Patent: Dec. 6, 1994

[54] SHEET-SUPPORTING MECHANISM FOR PRINTING PRESS

[75] Inventors: Erich Pietsch, Offenbach am Main; Jurgen Grobklab, Darmstadt; Reinhold Achenbach, Obertshausen, all of Germany

[73] Assignee: MAN Roland Druckmaschinen AG, Germany

[21] Appl. No.: 162,497

[22] Filed: Dec. 3, 1993

[30] Foreign Application Priority Data

Dec. 3, 1992 [DE] Germany ..... 4240660

[51] Int. Cl.[5] ..... B41F 13/24; B65H 9/00

[52] U.S. Cl. ..... 101/232; 271/240; 271/253

[58] Field of Search ..... 101/232; 271/213, 223, 271/224, 226, 240, 236, 248, 253, 251

[56] References Cited

U.S. PATENT DOCUMENTS 4,844,441 7/1989 Mutohashi ..... 271/240
5,087,028 2/1992 Fröhlich ..... 271/240
5,197,382 3/1993 Goodwin ..... 101/232
5,259,309 11/1993 Stiel ..... 101/232

FOREIGN PATENT DOCUMENTS

0268693B1 10/1989 European Pat. Off. .
4105966C1 5/1992 Germany .

*Primary Examiner*—Eugene H. Eickholt
*Attorney, Agent, or Firm*—Leydig, Voit & Mayer, Ltd.

[57] ABSTRACT

A sheet-supporting mechanism for supporting sheets above a side guide recess in the feed table of a sheet-fed rotary printing press includes a plurality of guide bridges disposed in the recess parallel to the direction of sheet travel and slidably mounted on tie-bars in the recess for movement transverse to the direction of sheet travel. A plurality of compression springs are interposed between the lateral faces of the guide bridges to bias the bridges apart and permit the sheet side guide to move in the recess transverse to the direction of sheet travel in order to accommodate sheet formats of varying widths. The springs are preferably leaf springs and are disposed below the upper surface of the bridges which lie in the plane of the surface of the feed table.

6 Claims, 3 Drawing Sheets

SHEET-SUPPORTING MECHANISM FOR PRINTING PRESS

FIELD OF THE INVENTION

The present invention relates to a sheet-supporting mechanism for a feed table of a sheet-fed rotary printing press having an adjustable sheet side guide.

BACKGROUND OF THE INVENTION

A sheet-supporting mechanism of this general kind is known from German Auslegeschrift 1611362, as a "slidable lattice grate table." As disclosed here, a plurality of sinuous spring bands, which stand vertically upright and support the supplied sheets, in the direction of sheet travel, are arranged as variable-length table surfaces within a side guide recess of the feed table.

A further sheet-supporting mechanism is known from EPO268693B1. Here, a plurality of displaceable receiving elements are arranged, in the region of the recess, transversely to the direction of sheet travel. The receiving elements, which act as leaf springs and are guided on rods, include leg regions and V-shaped or U-shaped connecting regions, which are arranged edgewise and are situated in the plane of the feed table surface. They are pre-tensioned and can be compressed whenever the side guide recess is reduced in size and are automatically re-set whenever the recess is enlarged.

A drawback of the foregoing arrangement is that, the linear deformation within the recess (for adjustment to sheet width or format) is always accompanied by a dimensional variation (linear deformation in width) in the spring bands in the direction of sheet travel. This leads to "irregularities" in respect to the sheet transport, since particularly in the case of thin print material or high press speeds, there is no guarantee of the sheet being securely supported. There is the further drawback that, due to the geometry of the spring construction, disturbances occur in sheet travel if the edges of the print material are roughly cut or deformed since, for example, the sheet edge gets caught in the spring bands.

In DE4 105 966 C1, a cover device endeavors to eliminate these drawbacks. As shown here, cover bars which are supported against springs, in the recess of the feed table, are arranged such that they are movable perpendicularly to the table surface. A sliding block acts on the cover bars from above and forces them into the recess against the spring force.

Although this solution improves the sheet-guidance, in that the cover bars do not give rise to any dimensional variation, it is nevertheless very complex. Dust and dirt cannot be carried away and, therefore, is able to accumulate between the cover bars. Since these cover bars completely cover the side guide recess, no additional means for the guidance or alignment of the sheets (such as a pneumatic mechanism) can be used to guide the sheet in this region.

OBJECTS AND SUMMARY OF THE INVENTION

The primary aim of the present invention is to provide an improved yet simple sheet-supporting mechanism for supporting sheets traveling above a side guide recess in the sheet feed table wherein at least one side guide is adjustably movable in the recess and a plurality of spring biased guide bridges are slidably mounted in the recess for supporting the sheets.

According to the invention, the guide bridges are situated parallel to the direction of sheet travel and guarantee a reliable guidance of the print material since no spring elements are in contact with the printed sheets. It is a further feature of the invention that dust and dirt can be transported away and additional means for assisting sheet guidance can be introduced into the side guide recess because the guide bridges can be quickly and easily removed either with or without the biasing spring elements.

Pursuant to another aspect of the invention, dimensional variations in the direction of sheet travel are precluded so that disturbances in the case of rough cut or damaged print material edges are avoided. Preferably, compression springs in the form of leaf springs are interposed between adjacent ones of the guide bridges and the springs are pre-tensioned so that they can be compressed to adjust to small print material formats and can be automatically expanded and re-set to adjust to larger formats. Moreover, at the same time, the guide bridges always remain parallel to the direction of sheet travel and remain situated in the plane of the feed table.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
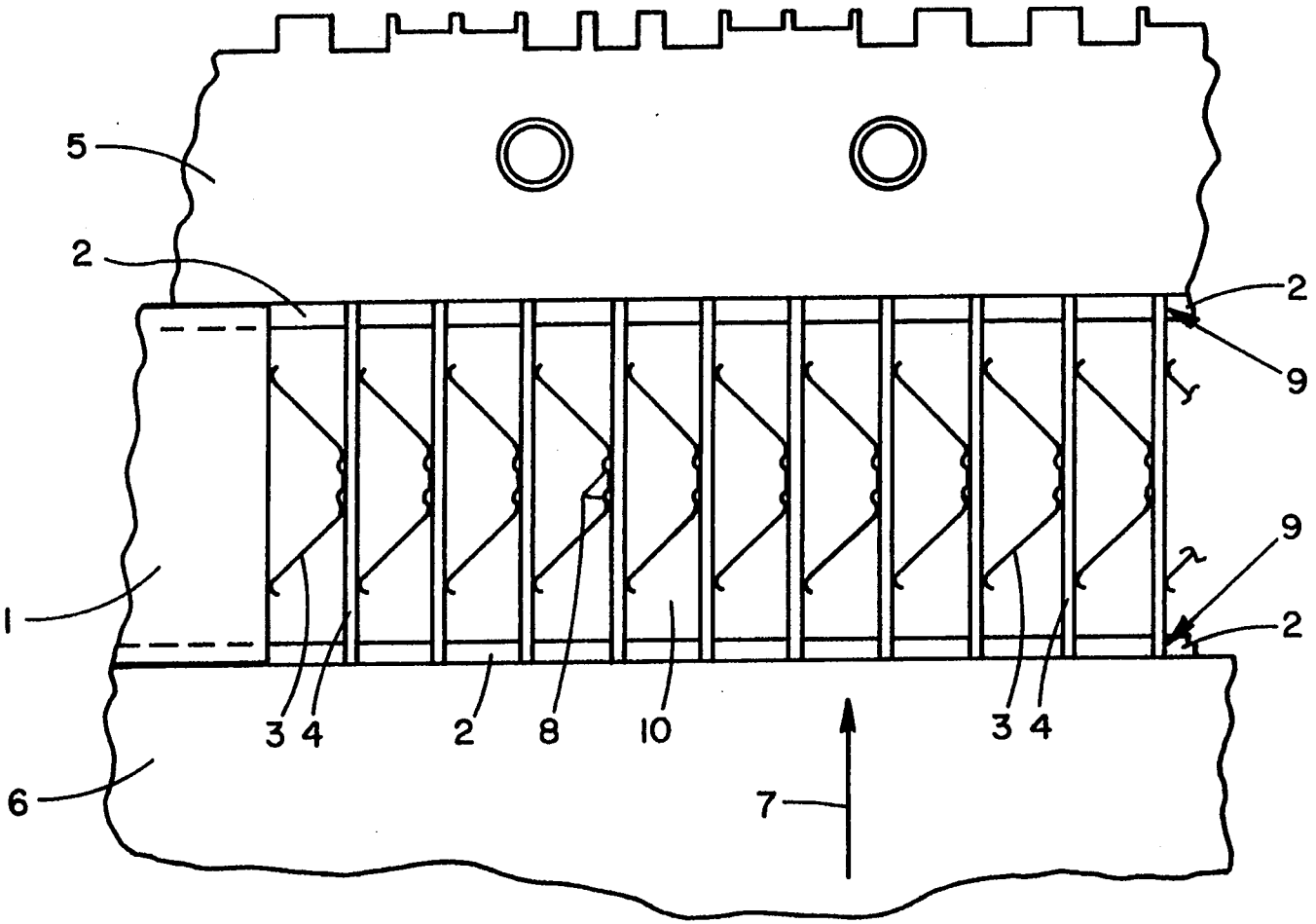
FIG. 1 is a diagrammatic top view of the sheet-supporting mechanism of the present invention with portions broken away and with the side guide set at the maximum setting for the widest sheet format.
Figure 2:
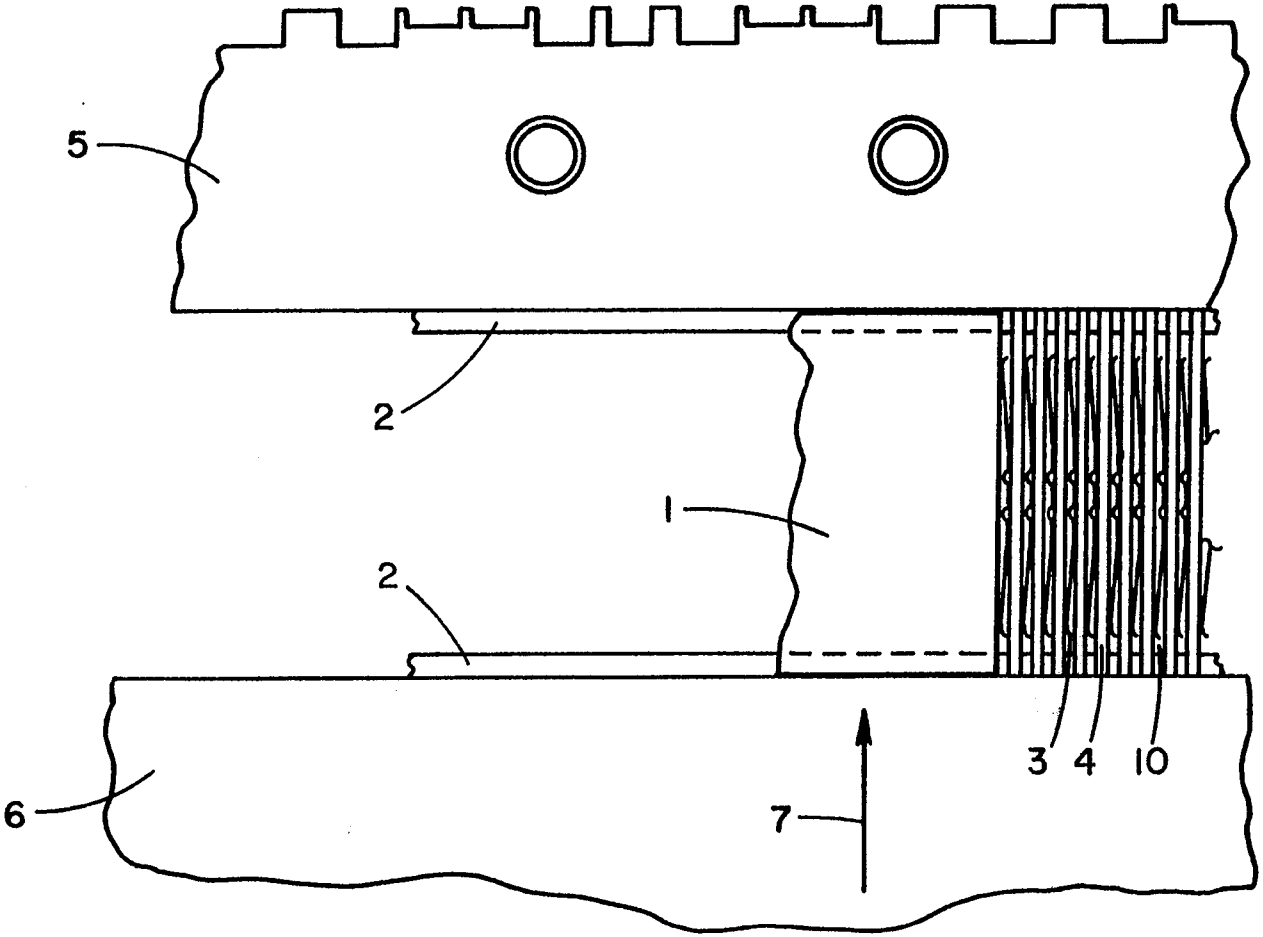
FIG. 2 is a diagrammatic top view, similar to FIG. 1, with the side guide set at the minimum setting for sheets having the narrowest format.

Turning now to the drawings, FIGS. 1 and 2 show a portion of a sheet feed table 6 of a sheet-fed rotary printing press having an entry feed plate 5. A recess 10 formed between the feed plate 5 and feed table 6 receives an adjustable sheet side guide 1 movable transversely to the direction of sheet delivery indicated here by arrow 7. As shown in FIG. 1, the side guide 1 is moved laterally outward to its maximum position for guiding the side edges of sheets of maximum width. In FIG. 2, the side guide 1 is moved laterally inward to its minimum position for guiding the edges of sheets having the narrowest width.

In accordance with the present invention, sheet-supporting means are disposed in the recess 10 to support movement of the sheets from the feed table 6 onto the feed plate 5 of the press. In the preferred embodiment, the sheet-support means includes a plurality of guide bridges 4 disposed in the recess 10 and spanning the distance between the feed plate 5 and the feed table 6.

Figure 3:
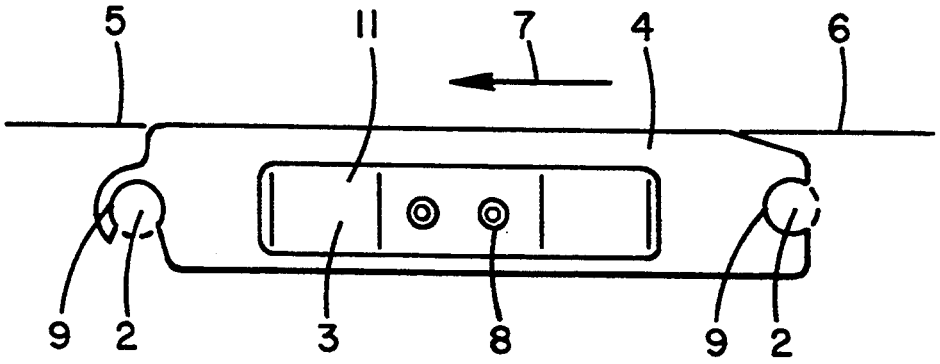
FIG. 3 is an enlarged side elevational view of one of the guide bridge elements.
Figure 4:
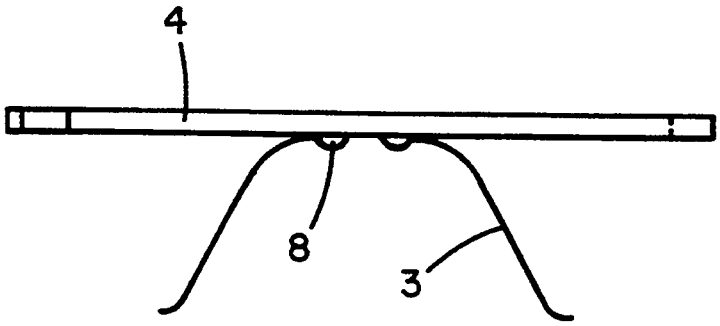
FIG. 4 is a top plan view of the guide bridge element shown in FIG. 3.

Beneath the guide bridges 4 a pair of spaced-apart tie-bars 2 are disposed in the recess 10 so as to extend substantially parallel to one another and transversely with respect to the direction of sheet travel 7. Each of the guide bridges 4 is slidably supported on the tie-bars 2 and in the preferred embodiment the sliding connection includes a thrust joint 9 as each end of the tie-bar to resist movement thereof parallel to the direction of sheet travel 7. As also shown in FIG. 3, the upper surface of the guide bridges are situated on the same level as the top surfaces of the feed table 6 and the feed plate 5.

Pursuant to another aspect of the invention, compression spring means are interposed between adjacent ones of the guide bridges 4 and serve to bias the bridges 4 apart. On a lateral face of each guide bridge 4 a compression spring 3, preferably in the form of a leaf spring is secured by connecting elements 8, located generally centrally on the lateral face of the guide bridge 4. As shown in FIG. 1, the leaf springs 3 are supported at their center with their outwardly extending legs biased into engagement with the lateral face of the next adjacent guide bridge 4. Referring to FIG. 2 it will be seen that the elongated length or the spring 3 when in its compressed form is shorter than the length of the guide bridge 4. It will also be seen in FIG. 3 that the top edge 11 of the leaf spring 3 is disposed below the top of the guide bridge 4 so that the springs 3 do not contact or interfere with the sheets or other print material being transported in the direction of travel 7 and the sheets are, therefore, supported above the recess 10 solely by the guide bridges 4.

In order to accommodate different print formats and sheets of different widths, the sheet side guide 1 can be shifted laterally in the recess 10 generally transversely to the direction of sheet delivery 7. If the format width is reduced, the side guide 1 is moved in the recess 10 toward the center of the feed table 6, thereby decreasing the distance between the guide bridge 4 and compressing the leaf springs 3 (see FIG. 2). Conversely, if the format width is enlarged, the side guide 1 is moved laterally in the direction of the outside of the feed table 6 (see FIG. 1). The compression springs 3 are thereby relaxed and the guide bridges 4 are automatically forced apart. At the same time, the guide bridges are precisely guided and maintained in parallel to the direction of sheet travel 7 by means of the thrust joints 9 formed with the tie-bars 2.

In a modification of the invention, compression springs 3 are secured on both lateral faces of alternate ones of the guide bridges 4. The other guide bridges 4, without compression springs are inserted in the recess 10 between pairs of the guide bridges having springs 3 on both sides. In a further embodiment, the spring 3 may be arranged on both sides of each guide bridge 4 but at different levels so as not to interfere with one another. Alternatively the springs 3 may be arranged in staggered relation so as to overlap with one another between an adjacent pair of guide bridges 4. In any case, however, the top edges 11 of all of the springs 3 should remain below the top of the guide bridges situated generally in the plane of the top of the feed table 6 and the feed plate 5.

We claim as our invention:

1. A sheet-supporting mechanism for supporting sheets traveling above a side guide recess formed between the feed table and a feed plate of a rotary printing press having at least one side guide engageable with one side of the traveling sheets and adjustably movable transversely thereto to guide sheets having different transverse dimensions, comprising in combination, a pair of parallel tie bars disposed in said side guide recess in spaced-apart relation transverse to the direction of sheet travel, a plurality of guide bridges slidably mounted on said tie bars in said recess and disposed substantially parallel to the direction of sheet travel, each of said guide bridges having an upper surface disposed substantially in the plane of said feed table and said feed plate and having a pair of lateral faces disposed perpendicular thereto, and a plurality of compression springs interposed between the opposed lateral faces of adjacent ones of said guide bridges for urging said guide bridges apart transverse to the direction of sheet travel.

2. A sheet-supporting mechanism as defined in claim 1 wherein the top edges of said compression springs are disposed below the upper surfaces of said guide bridges.

3. A sheet-supporting mechanism as defined in claim 2 wherein said compression springs are in the form of leaf springs each having an elongated length when compressed that is shorter than the length of said guide bridges.

4. A sheet-supporting mechanism as defined in claim 3 wherein said leaf springs are secured to the lateral faces of said guide bridges substantially adjacent the longitudinal mid-point thereof.

5. A sheet-supporting mechanism as defined in claim 4 wherein said leaf springs are secured to both lateral faces of alternate ones of said guide bars and are unsecured with respect to the other ones of said guide bars.

6. A sheet-supporting mechanism as defined in claim 1 wherein said slidable mounting of said guide bridge on said tie bars includes a thrust connection at each end of said guide bridge to resist longitudinal movement of said guide bars parallel to the direction of sheet travel.

* * * * *